US006542702B2

(12) United States Patent
Ahn et al.

(10) Patent No.: US 6,542,702 B2
(45) Date of Patent: Apr. 1, 2003

(54) METHOD OF MEASURING THE VOLUME OF TONER CONSUMED IN PRINTER AND APPARATUS THEREFOR

(75) Inventors: Man-gi Ahn, Chungcheonnam-do (KR); Jin-su Yun, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/841,485

(22) Filed: Apr. 25, 2001

(65) Prior Publication Data

US 2002/0090222 A1 Jul. 11, 2002

(30) Foreign Application Priority Data

Jan. 6, 2001 (KR) ..... 2001-835

(51) Int. Cl.[7] ..... G03G 15/08
(52) U.S. Cl. ..... 399/27; 347/7
(58) Field of Search ..... 347/7; 399/27, 399/29, 61, 143, 255, 258, 262, 58, 59, 62, 63

(56) References Cited

U.S. PATENT DOCUMENTS 5,204,699 A * 4/1993 Birnbaum et al. ..... 346/160
5,349,377 A * 9/1994 Gilliland et al. ..... 346/153

* cited by examiner

*Primary Examiner*—Hoang Ngo
(74) *Attorney, Agent, or Firm*—Sughrue Mion, PLLC

(57) ABSTRACT

A method and apparatus for measuring the volume of toner consumed in a printer using a beam modulation technique, wherein: printing data, which is input in units of multiple numbers of bits per pixel in synchronization with a video clock signal, is converted into bit values corresponding to equal sections into which each pixel is divided depending on the number of bits per pixel. Next, a carry value is obtained by summing the bit values corresponding to the number of converted sections of printing data with the previous bit value. Then, the carry value obtained in this manner is counted. The counted carry value is multiplied by a predetermined value, and the volume of toner consumed is measured using the resulting product.

7 Claims, 5 Drawing Sheets

METHOD OF MEASURING THE VOLUME OF TONER CONSUMED IN PRINTER AND APPARATUS THEREFOR

BACKGROUND OF THE INVENTION

1. Field of the Invention

The present invention relates to a method and apparatus for measuring the volume of toner consumed in a printer and, more particularly, to a method and apparatus for measuring the volume of toner consumed in a printer adopting a video data modulation technique.

This application is based on Korean Patent Application No. 2001-835, filed Jan. 6, 2001, which is incorporated herein by reference in its entirety.

2. Description of the Related Art

As shown in FIG. 1, a printer 102 is typically connected to a computer 101 via a communications interface 103. The computer 101 transmits data made by a user to the printer 102 via the interface 103, and the printer 102 internally processes received data and prints the processed data. Here, reference numeral 101*a* denotes an application program, reference numeral 101*b* denotes a printer driving program, reference numeral 102*a* denotes a printer controller board, reference numeral 102*b* denotes a printer engine, and reference numeral 102*c* denotes a manipulation panel.

In the prior art, a printer as described above adopts a sensor (not shown) to measure the volume of toner consumed. However, this printer is required to take remedial measures due to a lack of reliability and accuracy of the sensor that cause the malfunction of the sensor and/or difficulties with the use of the sensor. Consequently, a technique for counting a number of printing data that synchronizes with a video clock and for informing the system of a state of "toner exhaustion" when the counted value reaches a predetermined reference value has been developed.

FIG. 2 is a block diagram schematically illustrating the structure of a conventional apparatus for measuring the volume of toner consumed, which adopts the aforementioned technique. Referring to FIG. 2, a conventional data required amount calculating apparatus 200 is made up of a count effective signal generation unit 201, a counting unit 202 and a total counted value and reference value storage unit 203. The count effective signal generation unit 201 receives video printing data and a video clock signal VCLK for synchronizing the print data from the computer 101 and generates an effective signal. Here, the video printing data and the video clock signal VCLK are generated by the printer controller board 102*a*. The counting unit 202 counts the number of pulses of a generated effective signal and calculates the number of video printing data actually required to print one page. The storage unit 203 accumulates counted values.

When a printer adopting the conventional data required amount calculating apparatus 200 having such a structure prints a pixel, the effective signal generation unit 201 generates an effective signal in which printing data keeping a value of 1 exists within a video clock. Then, the counting unit 202 counts the number of pulses of an effective signal generated while one page is being printed. Finally, the printer controller board 102*a* compares the accumulated value with a reference value and measures the volume of toner consumed.

In this conventional method of measuring the volume of toner consumed, the count effective signal generation unit 201, which is an AND gate, combines the bits of printing data. Thus, this conventional method is suitable for printers in which printing data is capable of expressing only two values, 0 and 1, and is allocated for a pixel that can be a barometer of the resolution, and then printed. However, in the event that the number of bits of received printing data changes to 8 bits, 4 bits and 2 bits in order to improve the quality of image, in particular, in the event of beam modulation (video data modulation) printers, this conventional method cannot accurately calculate the printing data that is actually required, and, consequently, cannot accurately measure the volume of toner consumed.

SUMMARY OF THE INVENTION

To solve the above problems, an objective of the present invention is to provide a method of measuring the volume of toner consumed, by which the volume of toner consumed can be accurately measured by calculating the exact volume of printing data actually required even when a multiple printing data value is allocated to one pixel, as in beam modulation printers.

Another objective of the present invention is to provide an apparatus for measuring the volume of toner consumed, which adopts the particular toner consumed volume measuring method in use by the printer.

To achieve the first objective, the present invention provides a method of measuring the volume of toner consumed in a printer, the method including the steps of: (a) converting printing data, which is input in units of multiple bits per pixel in synchronization with a video clock signal, into bit values corresponding to equal levels into which each pixel is divided depending on the number of bits; (b) generating a carry value by summing the bit values corresponding to the levels of printing data converted in step (a) with the previous bit value; (c) counting the carry value generated in step (b); and (d) multiplying the counted value obtained in step (c) by a predetermined value and measuring the volume of toner consumed using the resulting product.

To achieve the second objective, the present invention provides an apparatus for measuring the volume of toner consumed in a printer, the apparatus including: a buffer control unit for converting printing data, which is input in units of multiple bits per pixel, in synchronization with a video clock signal, into bit values corresponding to equal sections into which each pixel is divided depending on the number of bits; a summing register for generating a carry value by summing the bit values corresponding to the sections of printing data converted by the buffer control unit and a pre-stored bit value; a counting unit for counting the carry value generated by the summing register, thus generating a counted value; a multiplier for multiplying the counted value obtained by the counting unit by a predetermined number, thus obtaining a counted value product; a counted value storage unit for storing the counted value product; and a microcomputer for setting the counted value product to be a value for measuring the volume of toner consumed.

BRIEF DESCRIPTION OF THE DRAWINGS

The above objectives and advantage of the present invention will become more apparent by describing in detail a preferred embodiment thereof with reference to the attached drawings, in which.

DETAILED DESCRIPTION OF THE PREFERRED EMBODIMENT

Figure 1:
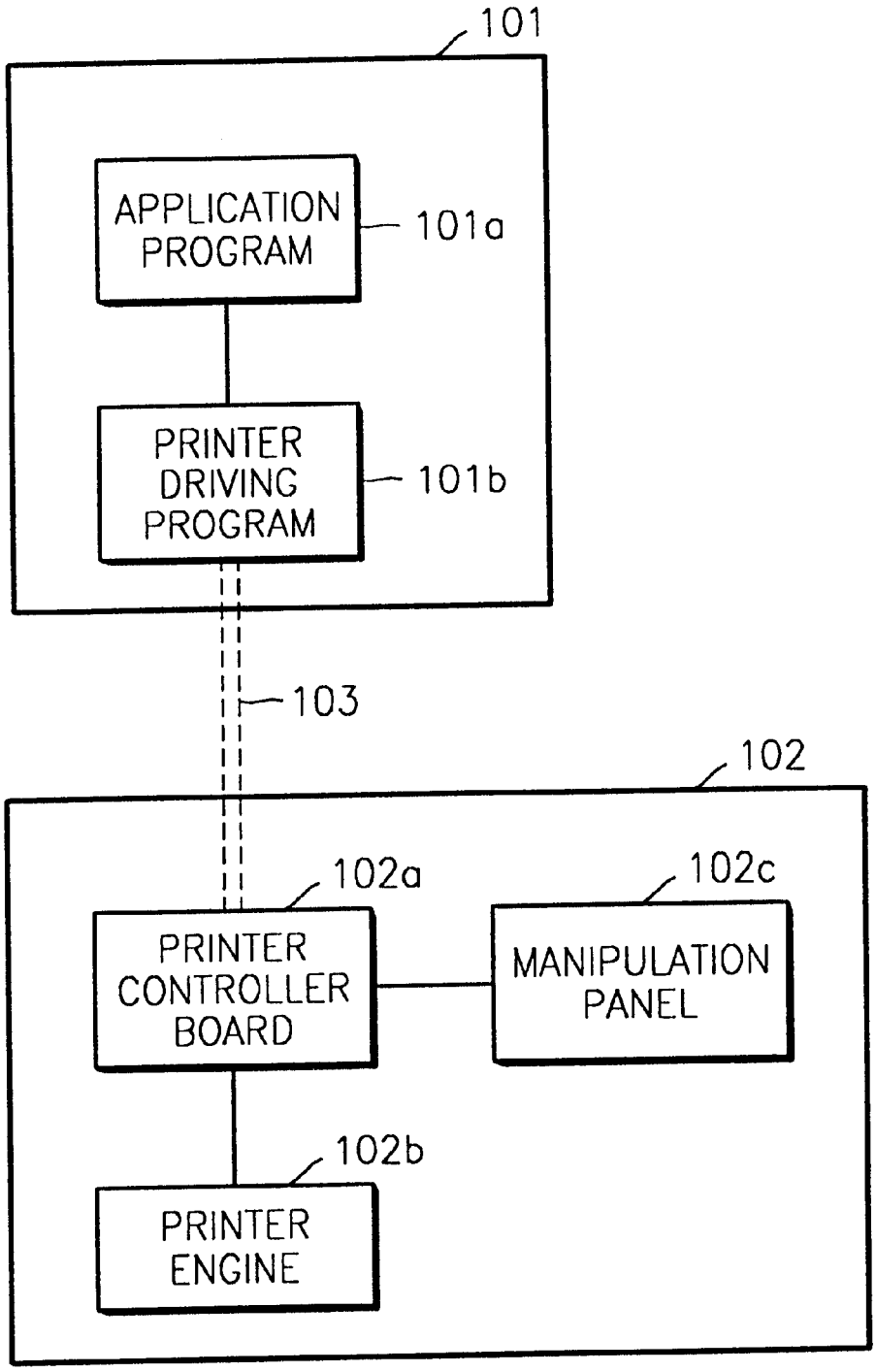
FIG. 1 (PRIOR ART)
FIG. 1 is a block diagram schematically illustrating the structure of a printer that is typically connected to a computer.
Figure 2:
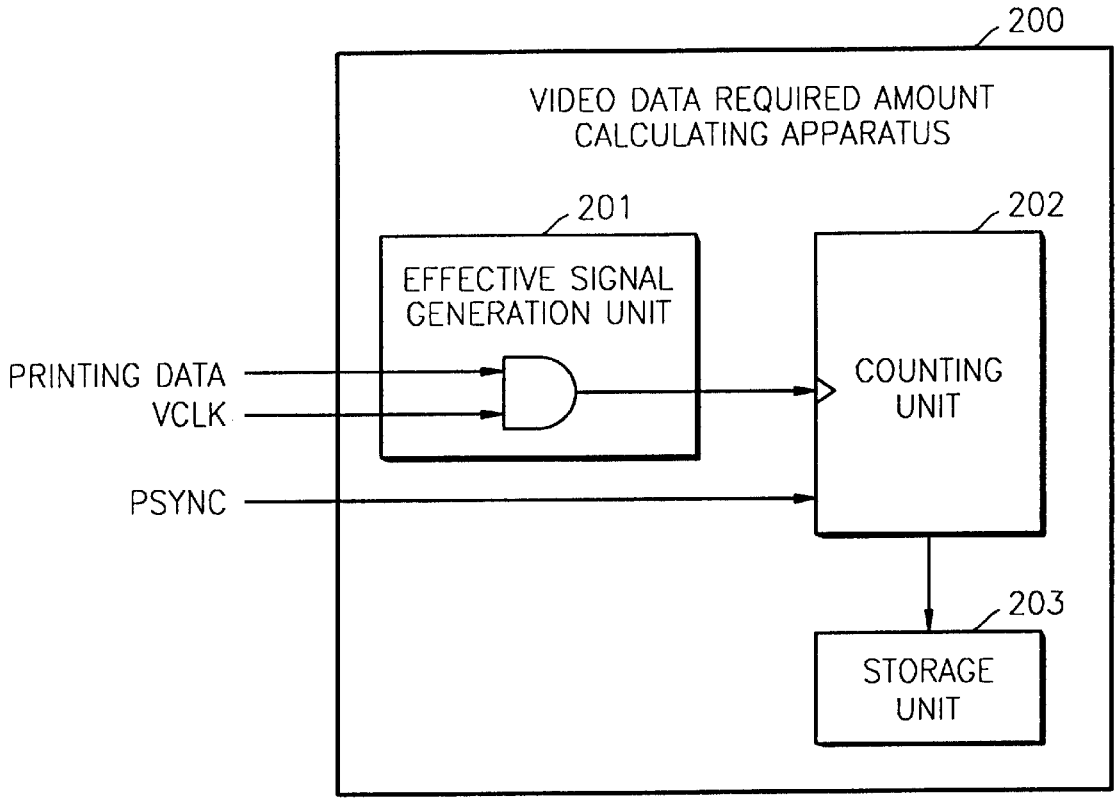
FIG. 2 (PRIOR ART)
FIG. 2 is a block diagram schematically illustrating the structure of a conventional apparatus for measuring the volume of toner consumed.
Figure 3:
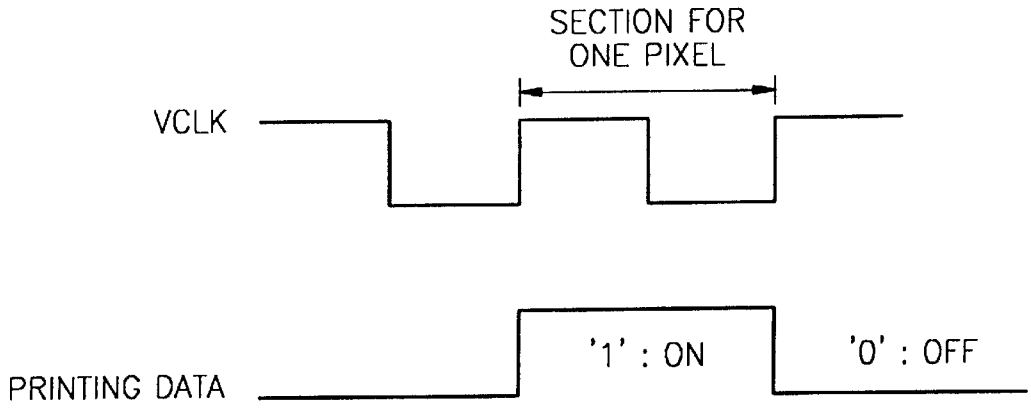
FIG. 3 (PRIOR ART)
FIG. 3 is a signal waveform view of printing data and a video synchronization clock signal that are input to the count effective signal generation unit of FIG. 2.
Figure 4:
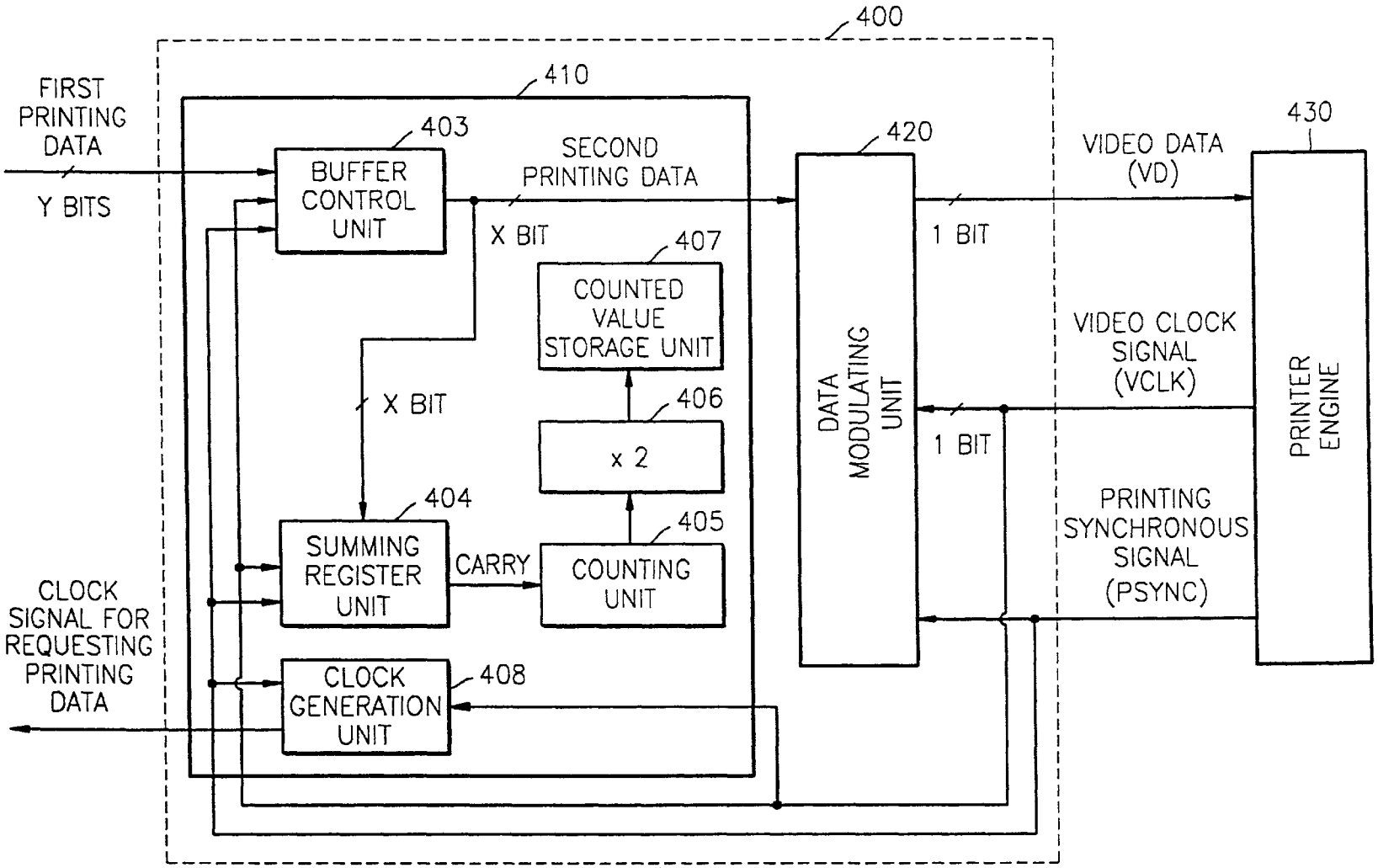
FIG. 4 is a block diagram schematically illustrating the structure of an apparatus for measuring the volume of toner consumed in a printer according to the present invention.

Referring to FIG. 4, a printer for measuring the volume of toner consumed, according to the present invention, is made up of a print video controller 400 and a printer engine 430. The printer engine 430 generates a video clock signal VCLK and a printing synchronous signal PSYNC and applies them to a data modulation unit 420 in the print video controller 400.

The print video controller 400 is made up of a counted value generation unit 410 and the data modulation unit 420. The counted value generation unit 410 is made up of a buffer control unit 403, a summing register unit 404, a counting unit 405, a multiplying unit 406, a counted value storage unit 407, and a clock generation unit 408.

In the counted value generation unit 410, the clock generation unit 408 receives a video clock signal VCLK from the printer engine 430 and generates a clock signal for requesting printing data from an external computer. The buffer control unit 403 stores first printing data (Y bits) made up of several pixels, each of which has a plurality of bits (X bits), in a buffer (not shown) in response to the video clock signal VCLK and the printing synchronous signal PSYNC received from the printer engine 430, and converts the first printing data into second printing data (X bits) by dividing the first printing data into equal parts each having a number of bits equal to the number of bits in each pixel (X bits). The buffer control unit 403 outputs the second printing data to the data modulation unit 420. Here, the first printing data can be data having a variable number of pixels, such as 1-pixel data, 2-pixel data, 4-pixel data, 8-pixel data, 16-pixel data or the like. The second printing data has a number of bits, which are equal to the number of bits in each pixel, such as, 1 bit, 2 bits, 4 bits or 8 bits. The summing register unit 404 sums the bit value for the second printing data generated by the buffer control unit 403 and the bit value stored in itself in response to the video clock VCLK and the printing synchronous signal PSYNC received from the printer engine 430, and then generates a carry. At this time, the summing register unit 404 stores the sum until a subsequent instance of second printing data is received, and outputs a carry value obtained by using the most significant bit as a carry to the counting unit 405. Also, the summing register unit 404 adds 1 upon the next summation in order to compensate for a loss value of 1, which is generated every time the carry value is changed. The counting unit 405 increases a count value by 1 whenever the carry value generated by the summing register unit 404 is 1. The multiplying unit 406 multiplies the count value of the counting unit 405 since toner exhaustion or use continues even when the carry value changes from 1 to 0. The counted value storage unit 407 stores the product of the counted value multiplied by the multiplying unit 406. The microcomputer (not shown) measures the volume of toner with reference to the counted value product stored in the counted value storage unit 407.

The data modulation unit 420 receives the second printing data output from the buffer control unit 403 and outputs values modulated in accordance with $2^X$ (where the superscript power X denotes the number of bits in each pixel) levels in the form of video data (VD) to the printer engine 430 in response to the video clock signal VCLK and the printing synchronous signal PSYNC.

Figure 5:
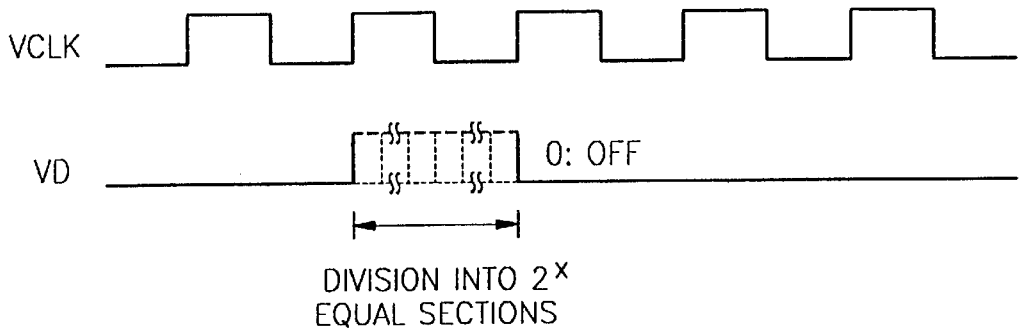
FIG. 5 is a waveform view of printing data which is received by the data buffer control unit of FIG. 4 and divided into equal parts depending on the number of bits in each pixel.

Referring to FIG. 5, the second printing data VD is partitioned into $2^X$ equal sections in one pixel period in synchronization with the video clock signal VCLK, and the divided $2^X$ equal levels are output for corresponding pulse durations. The value of the bits is measured as the volume of toner for a pixel.

Figure 6:
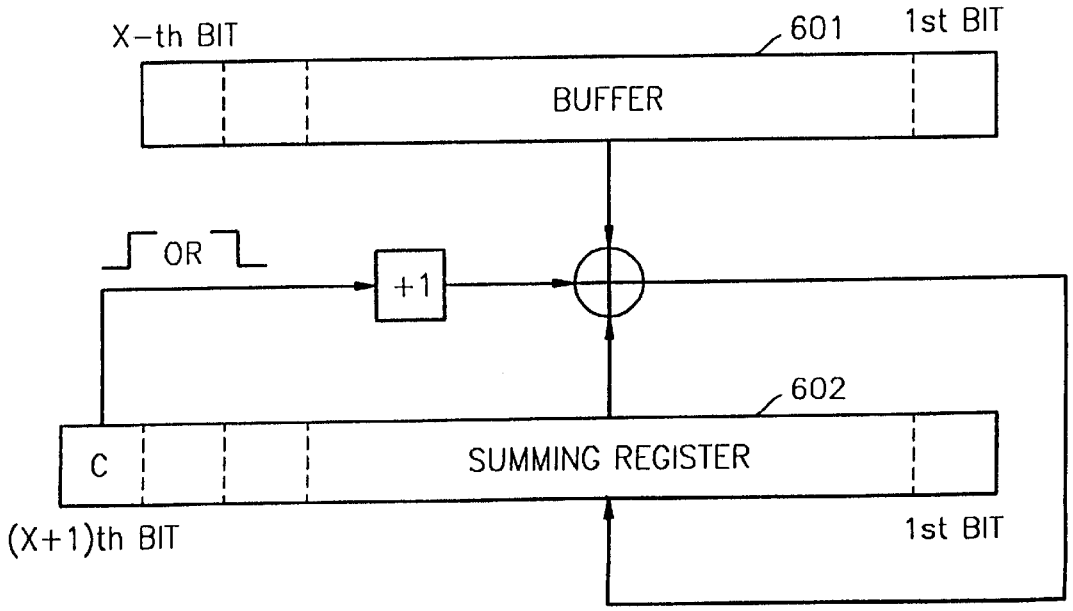
FIG. 6 is a conceptual diagram illustrating the arithmetic operation of the data buffer control unit and the summing register of FIG. 4.

Referring to FIG. 6, received first printing data, the number of bits of which is variable, is stored in a buffer 601 in the buffer control unit 403 and converted into second printing data having as many bits as the number of bits in each pixel. The bits of the second printing data are summed with the bits stored in a summing register 602 in the summing register unit 404. The buffer 601 in the buffer control unit 403 has X bit places and stores second printing data. The summing register 602 has (X+1) bit places, the number of which is one more than the number of bits of the second printing data, and stores the sum of the preceding second printing data. Thus, the summing register 602 sums the bits (X bits) stored in the buffer 601 and the (X+1) bits of the summing register 602 at the first video clock VCLK, stores the sum without change, and uses the (X+1)th bit place as a carry bit. At the second video clock VCLK, the summing register 602 sums the currently-stored bit value and the second printing data input at the second video clock VCLK and stores the sum in itself. Whenever a resultant value greater than the X-th bit is generated upon summation, the value of the carry bit, the (X+1)th bit, alternates between 0 and 1, and the converted carry bit is output to the counting unit 405.

The bit values summed by the summing register 602 are again summed with the bit value of the second printing data output from the buffer control unit 403 at every continuous video clock VCLK to generate a carry value, as described above. The carry value generated in this process repeatedly alternates between 0 and 1, and is a barometer for measuring the volume of toner of a video clock signal (VCLK) corresponding to one pixel. Whenever the carry value toggles between 0 and 1, a loss value is generated. In order to compensate for the loss value, 1 is added at the next video clock whenever the carry value toggles.

Figure 7:
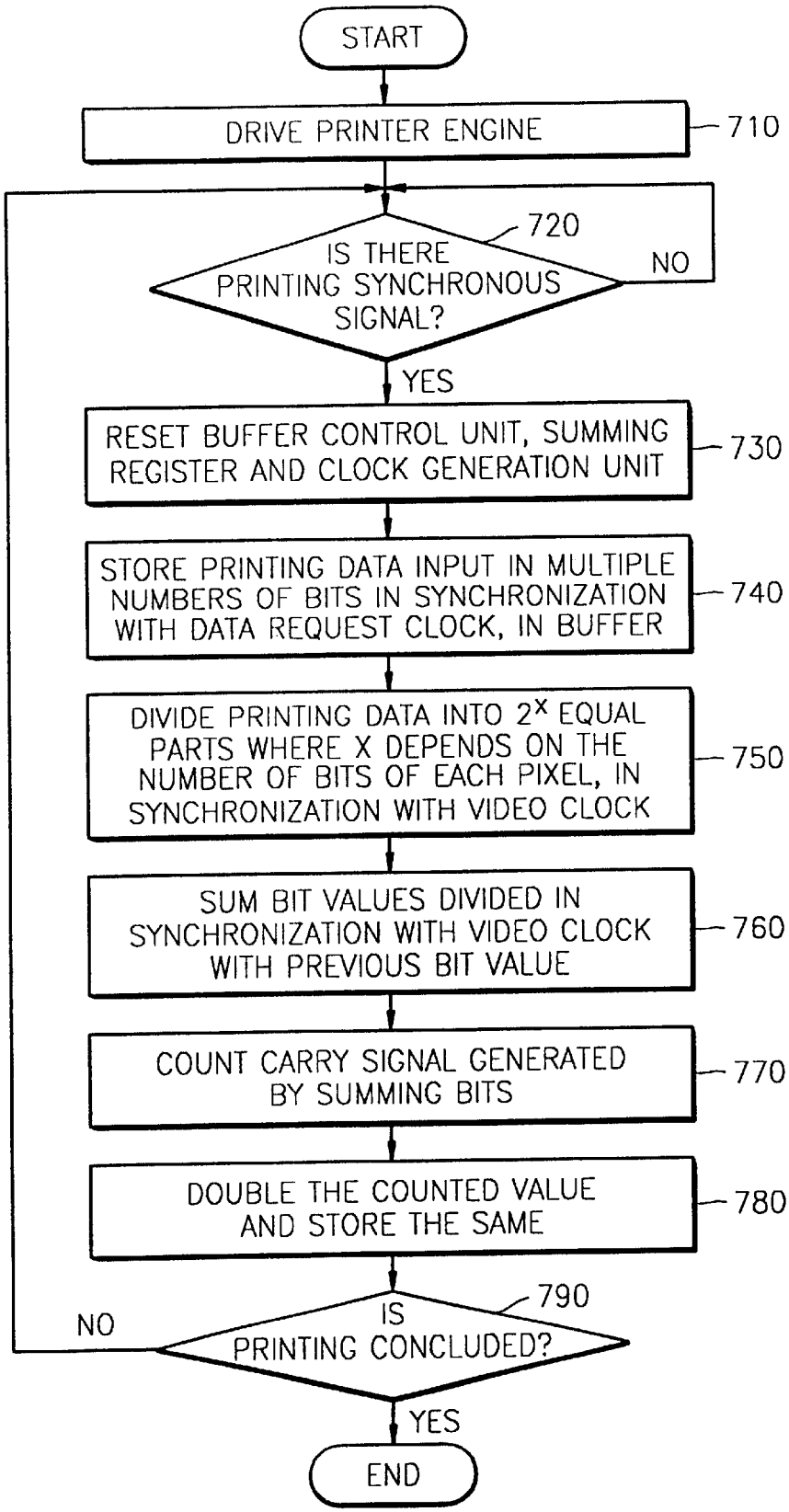
FIG. 7 is a flowchart for illustrating a method of measuring the volume of toner consumed in a printer according to the present invention.

FIG. 7 is a flowchart for illustrating a method of measuring the volume of toner consumed in a printer according to the present invention. First, the printer engine 430 is driven, in step 710, and a printing synchronous signal is detected, in step 720.

Next, when a printing synchronous signal is generated by the printer engine 430 and detected, the buffer control unit 403, the summing register 404, and the clock generation unit 408 are reset, in step 730. The clock generation unit 408 is used as a printing data request clock.

Then, printing data input in multiple numbers of bits in synchronization with the printing data request clock are stored in the data buffer control unit 403, in step 740.

Thereafter, the buffer control unit 403 converts the printing data input in synchronization with a video clock VCLK, into printing data whose each pixel is divided into $2^X$ (where X denotes the number of bits in each pixel) levels, in step 750.

Then, the summing register 404 generates a carry by summing the current bit value of printing data received in synchronization with the video clock signal VCLK with the previous bit value, and keeps the sum until the bit value of the next instance of printing data is received, in step 760. Here, the bit of the carry is not converted until the carry value reaches at least a value defining the full volume of toner consumed corresponding to a video clock. The generated carry value is counted by the counting unit 405, in step 770. The counting unit 405 should count the volume of toner corresponding to a video clock even when the carry value is 0, but counts the carry value only when the carry value is 1. Thus, to compensate and correct the counted value, the counting unit 405 doubles the carry value, thus generating a counted value product.

Then, the counted value product (doubled counted value) is accumulated in the counted value storage unit 407, in step 780.

Thereafter, the above-described steps are repeated until printing is concluded, in step 790.

Therefore, the counted value product stored in the counted value storage unit 407 is used to measure the total volume of toner consumed during printing.

As described above, the present invention measures the volume of toner consumed by receiving multiple-bit printing data instead of printing data made up of a fixed number of bits. Thus, the present invention measures toner use without requiring a sensor.

Although the invention has been described with reference to a particular embodiment, it will be apparent to one of ordinary skill in the art that modifications of the described embodiment may be made without departing from the spirit and scope of the invention. That is, the present invention can be applied to all types of printers that use beam modulation.

According to the present invention as described above, printing data having several pixels, each of which has a multi-bit information value, is output as printing data having as many bits as the number of bits in each pixel, and then printing data actually required is accurately calculated by continuous bit summing of the equal sections of printing data. Thereby, the volume of toner consumed is accurately measured.

What is claimed is:

1. A method of measuring a volume of toner consumed in a printer, the method comprising the steps of:

partitioning printing data having units of multiple pixels, into parts, each part having as many bits as a number of bits in each pixel, said partitioning performed in synchronization with a video clock signal;

generating a carry value by summing the bits of a corresponding one of the parts into which the printing data is partitioned with the bits of a previous part; and counting the generated carry value to obtain a counted value.

2. A method of measuring a volume of toner consumed in a printer, the method comprising the steps of:

partitioning printing data having units of multiple pixels, into parts, each part having as many bits as a number of bits in each pixel, said partitioning performed in synchronization with a video clock signal;

generating a carry value by summing the bits of a corresponding one of the parts into which the printing data is partitioned with the bits of a previous part;

counting the generated carry value to obtain a counted value; and adding 1 at a next video clock signal in order to compensate for a loss value which is generated when the carry value toggles at a prior video clock signal.

3. A method of measuring a volume of toner consumed in a printer, the method comprising the steps of:

partitioning printing data having units of multiple pixels, into parts, each part having as many bits as a number of bits in each pixel, said partitioning performed in synchronization with a video clock signal;

generating a carry value by summing the bits of a corresponding one of the parts into which the printing data is partitioned with the bits of a previous part;

counting the generated carry value to obtain a counted value; and multiplying the counted value by a predetermined value and measuring the volume of toner consumed using the resulting product.

4. A method of measuring a volume of toner consumed in a printer, the method comprising the steps of:

partitioning printing data having units of multiple pixels, into parts, each part having as many bits as a number of bits in each pixel, said partitioning performed in synchronization with a video clock signal;

generating a carry value by summing the bits of a corresponding one of the parts into which the printing data is partitioned with the bits of a previous part; and counting the generated carry value to obtain a counted value, wherein each pixel of the printing data is divided into $2^X$ equal sections in the step of partitioning, X being the number of bits in each pixel.

5. A method of measuring a volume of toner consumed in a printer, the method comprising the steps of:

partitioning printing data having units of multiple pixels, into parts, each part having as many bits as a number of bits in each pixel, said partitioning performed in synchronization with a video clock signal;

generating a carry value by summing the bits of a corresponding one of the parts into which the printing data is partitioned with the bits of a previous part;

counting the generated carry value to obtain a counted value; and doubling the counted value.

6. An apparatus for measuring a volume of toner consumed in a printer, comprising:

a buffer control unit which converts printing data having units of multiple bits per pixel, in synchronization with a video clock signal, into bit values corresponding to equal sections into which each pixel is divided, the number of sections varying according to the number of bits in each pixel;

a summing register which generates a carry value by summing each bit value corresponding to the sections of printing data converted by the buffer control unit and a prestored bit value;

a counting unit which counts the carry value generated by the summing register, thus obtaining a counted value;

a multiplier which multiplies the counted value obtained by the counting unit by a predetermined number, thus obtaining a counted value product;

a counted value storage unit which stores the counted value product; and a microcomputer which sets the counted value product to a value for measuring the volume of toner consumed.

7. The apparatus of claim 6, wherein the summing register includes bit places, the number of bit places being at least one more than a number of bits of printing data generated by the buffer control unit, to generate said carry value.

* * * * *